US007179164B2

(12) United States Patent
Arnold, Jr.

(10) Patent No.: US 7,179,164 B2
(45) Date of Patent: Feb. 20, 2007

(54) CHIMNEY CAP APPARATUS AND METHOD

(75) Inventor: John G. Arnold, Jr., Tulsa, OK (US)

(73) Assignee: European Copper, L.L.C., Tulsa, OK (US)

( * ) Notice: Subject to any disclaimer, the term of this patent is extended or adjusted under 35 U.S.C. 154(b) by 22 days.

(21) Appl. No.: 11/160,160

(22) Filed: Jun. 10, 2005

(65) Prior Publication Data

US 2006/0246833 A1 Nov. 2, 2006

Related U.S. Application Data

(63) Continuation-in-part of application No. 10/847,418, filed on May 17, 2004, now Pat. No. 6,926,600.

(51) Int. Cl.
*F23L 17/02* (2006.01)
*F23L 17/12* (2006.01)

(52) U.S. Cl. ..... 454/12; 454/35; 454/39

(58) Field of Classification Search ..... 454/12–14, 454/35–39

See application file for complete search history.

(56) References Cited

U.S. PATENT DOCUMENTS

| | | | | |
|---|---|---|---|---|
| 638,172 | A | | 11/1899 | Burress |
| 847,255 | A | | 3/1907 | Kobusch |
| 1,627,105 | A | | 5/1927 | Meier |
| 1,644,701 | A | | 10/1927 | Anderson |
| 2,381,178 | A | | 8/1945 | Munyon ..... 72/88 |
| 2,763,196 | A | | 9/1956 | Singleton |
| 2,856,837 | A | * | 10/1958 | Thulman ..... 454/37 |
| 3,103,158 | A | * | 9/1963 | Noll ..... 49/2 |
| 3,269,296 | A | | 8/1966 | Best |
| 3,817,162 | A | | 6/1974 | Guelph |
| 4,286,975 | A | | 9/1981 | Whiteley |
| 4,732,078 | A | | 3/1988 | Giumenta et al. |
| D299,529 | S | | 1/1989 | Best ..... D23/373 |
| 5,125,198 | A | | 6/1992 | Giumenta et al. |
| 5,402,613 | A | | 4/1995 | Giumenta et al. |
| 6,152,817 | A | | 11/2000 | Daniels et al. |

FOREIGN PATENT DOCUMENTS

| | | | | |
|---|---|---|---|---|
| GB | 0002653 | * | 0/1884 | ..... 454/40 |

* cited by examiner

*Primary Examiner*—Josiah Cocks
*Assistant Examiner*—Helena Kosanovic
(74) *Attorney, Agent, or Firm*—Head, Johnson & Kachigian

(57) ABSTRACT

A cap for a flue opening of a chimney in order to enhance draw of smoke and in order to protect from entry of animals, debris, and the elements. The device includes a tubular housing having sidewalls fabricated from flat sheet metal and a top attached to the sidewalls from fasteners. A plurality of louver openings are provided in the sidewalls in order to draw air. A plurality of exit vent openings in the sidewalls above the louver openings are at least equal to a cross-sectional area of the flue opening. An inner frame and mounting assembly includes a mechanism to both anchor the device to the chimney flue and to level the device.

17 Claims, 7 Drawing Sheets

CHIMNEY CAP APPARATUS AND METHOD

CROSS-REFERENCE TO PENDING APPLICATIONS

This application is a continuation-in-part patent application of U.S. patent application Ser. No. 10/847,418 filed May 17, 2004 now U.S. Pat. No. 6,926,600 and entitled "Chimney Cap Apparatus and Method".

BACKGROUND OF THE INVENTION

1. Field of the Invention

The present invention is directed to a cap for a flue opening of a chimney. In particular, the present invention is directed to a cap for a flue opening which extends the chimney in order to enhance draw of smoke, protect from the elements (such as rain, snow, and wind) and from entry of animals and debris, and provide a decorative external feature for a building.

2. Prior Art

Chimneys for houses and other buildings typically include a flue liner in a chimney which carries the smoke and exhaust upward to be disbursed into the atmosphere. Various caps have been proposed in the past to prevent rain and other elements from entering the opening of the flue. Various prior chimney caps also have been utilized to extend the length of the chimney. By way of example, Munyon (U.S. Pat. No. 2,381,178) provides a chimney extension formed of sheet metal secured by rivets 9 and clamps 10 having brackets 11 or 15. Past chimney caps also have been designed to prevent entry of debris or small animals into the chimney flue.

Various chimney caps in the past have been constructed of clay and masonry. While functional and decorative, they are extremely heavy and difficult to move to a roof top.

Also by way of example, Giumenta et al. (U.S. Pat. Nos. 4,732,078 and 5,402,613) disclose a chimney cap with four perforated sides formed from a flat metal blank. Flanges are used to attach to the chimney and a roof may be welded to the perforated sides of the chimney cap.

Notwithstanding the foregoing, there remains a need for a lightweight, decorative chimney cap that may be attached to a chimney with minimal effort and that may be adjustable in order to level the cap to the particular application and in order to permit easy removal if necessary.

There remains a need to provide a lightweight, decorative chimney cap that may be manufactured inexpensively without welding.

There remains a need to provide a lightweight, decorative chimney cap without clay or masonry that may be easily moved to the top of a roof and that would interface with (1) a masonry chimney; (2) a prefab masonry chimney or (3) a prefab metal chimney.

SUMMARY OF THE INVENTION

The present invention provides a chimney cap apparatus or device to be installed over a flue opening of a chimney. The device includes a tubular housing having a plurality of planar sidewalls fabricated from flat sheet metal. The sidewalls may be fabricated from two flat metal sheets, each flat metal sheet comprised of four panels each. The two sheets are brought together and joined at their seams.

Each sidewall panel may include a plurality of louver openings stamped or otherwise made into the sidewalls. Each louver opening faces upward away from the chimney. At the top of each sidewall panel, opposed to the louver openings are a plurality of exit openings. The total area of the exit openings is at least equal to the cross-sectional area of the flue opening.

A top is attached to the upper end of the sidewalls and may also be fabricated from flat sheet metal.

An inner frame and mounting assembly includes a mechanism to both anchor the device to the chimney and to level the device with respect to the chimney. The assembly includes a series of L-brackets fabricated from metal which is non-reactive and compatible with the sidewall flat sheet metal.

The mounting assembly also includes a plurality of clips which are receivable in receptacles in the L-brackets of the inner frame and mounting assembly. One side of the clip includes an opening for receiving a fastener which will be connected to the chimney. Each clip also includes an elongated slot which receives a fastener such as a bolt which would pass through the slot and through an opening in the sidewall. Accordingly, by adjusting the positioning of the fastener in the slot, the clip may be utilized to adjust the level of the device with respect to the chimney.

The device also includes a pair of parallel, continuous internal brace rings which are parallel to the L-brackets of the inner frame and mounting assembly. Internal corner braces supplement the stability and assist in joining together the sidewalls.

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Figure 1:
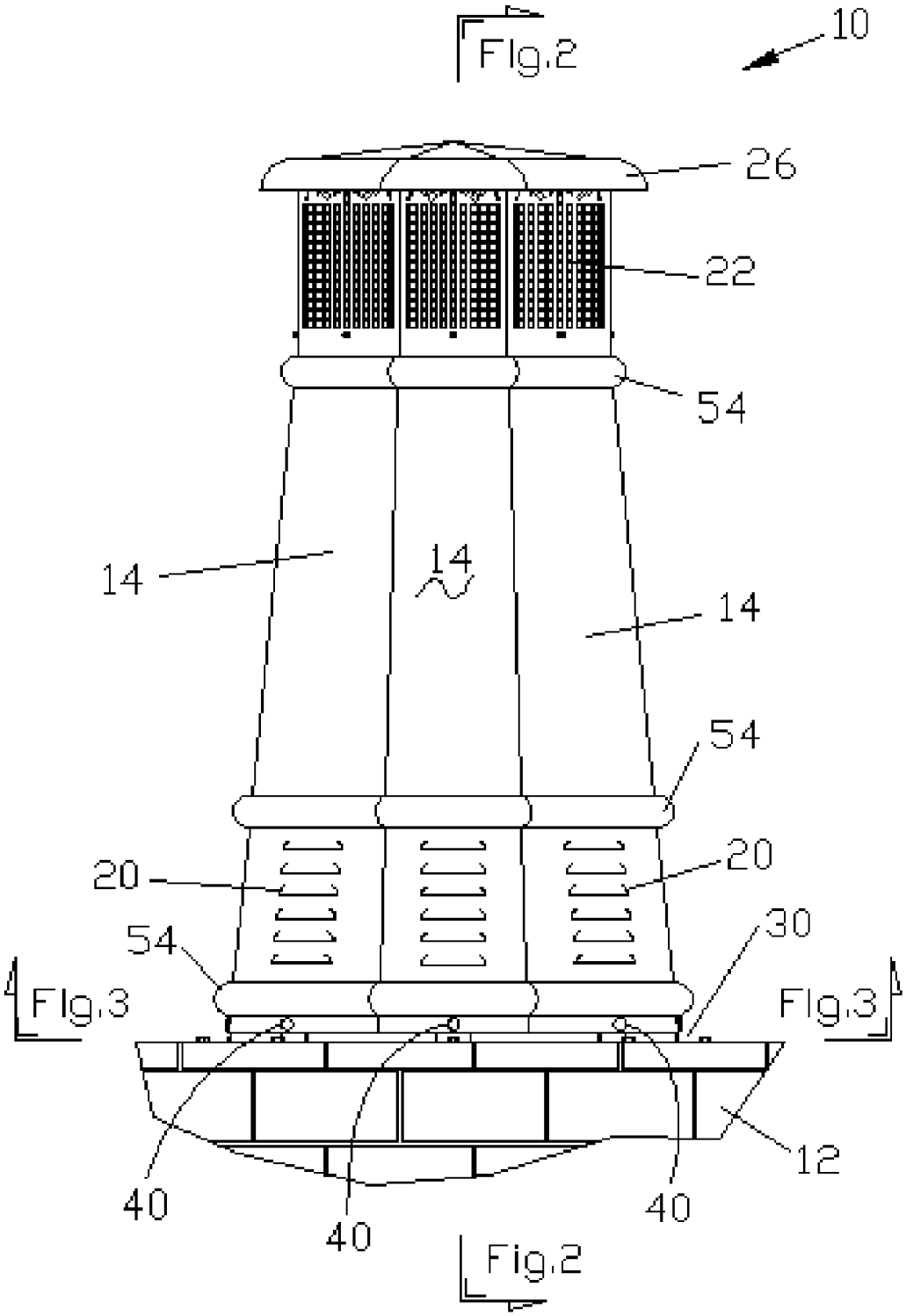
FIG. 1 is a side view of a chimney cap apparatus attached to a chimney as constructed in accordance with the present invention.

Referring to the drawings in detail, FIG. 1 illustrates a plan view of a cap apparatus or device 10 constructed in accordance with the present invention. The cap device is installed over a flue opening of a chimney 12, a portion of which is shown in FIG. 1. The device 10 would sit at the top of the chimney 12 and surround a flue opening (not visible). The device may be mounted on chimneys of various materials and configurations.

The device 10 includes a plurality of planar sidewalls which are fabricated from flat sheet metal. In the present embodiment, the sidewalls form an octagon and are truncated so to narrow moving away from the chimney toward the top. It will be understood that the device may have a cross-section in the form of a hexagon, square or other configuration within the spirit and scope of the present invention.

Figure 2:
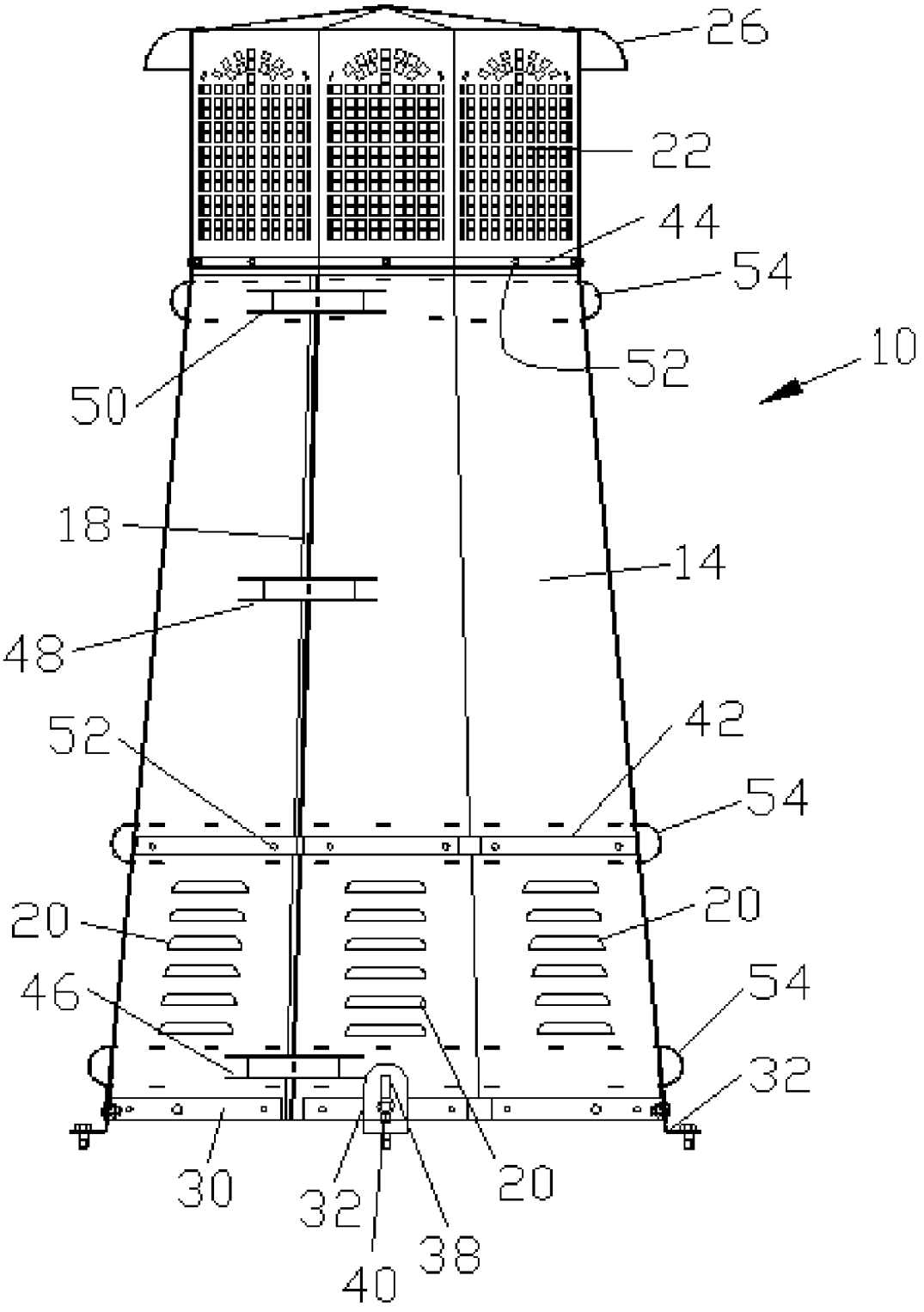
FIG. 2 is a sectional view of the chimney cap shown in FIG. 1 taken along section line 2—2 of FIG. 1 apart from the chimney.

FIG. 2 illustrates a sectional view of the device 10 taken along section line 2—2 of FIG. 1 apart from the chimney. The sidewalls 14 may be fabricated from two flat metal sheets, each flat metal sheet comprised of four panels each. The two sheets are then brought together and joined at seams 18. Each sidewall panel may include a plurality of louver openings 20 which are stamped, punched, formed or otherwise made into the sidewalls 14. Each louver opening 20 faces upward away from the chimney in the direction of the exiting smoke.

At the top of each sidewall panel, opposed to the louver openings are a plurality of exit openings 22 in the sidewalls. The exit openings 22 are stamped, punched, formed or otherwise made into the sidewalls. Each exit opening 22 is relatively small and would not allow for birds, squirrels, or other small animals to crawl therethrough. The exit openings 22 are provided so that the total area of the exit openings is at least equal to the cross sectional area of the flue opening and, in a preferred embodiment, is greater than the cross sectional area of the flue opening.

A top 26 is attached to the upper end of the sidewalls. The top 26 may also be fabricated from flat sheet metal. In the embodiment shown, the outer edge of the top is slit and the top is then rolled or pressed.

In the present embodiment, the sidewalls 14 and the top 26 are fabricated from copper metal which is decorative and lightweight but relatively soft.

The device 10 also includes an inner frame and mounting assembly 30. The assembly 30 includes a mechanism to both anchor the device 10 to the chimney and to level the device with respect to the chimney. As best seen in FIG. 2, the assembly 30 includes a series of L-brackets fabricated from metal which is non-reactive and compatible with the sidewall flat sheet metal. In the present preferred embodiment, the sidewalls are copper and the inner frame mounting assembly is constructed of stainless steel.

Figure 3:
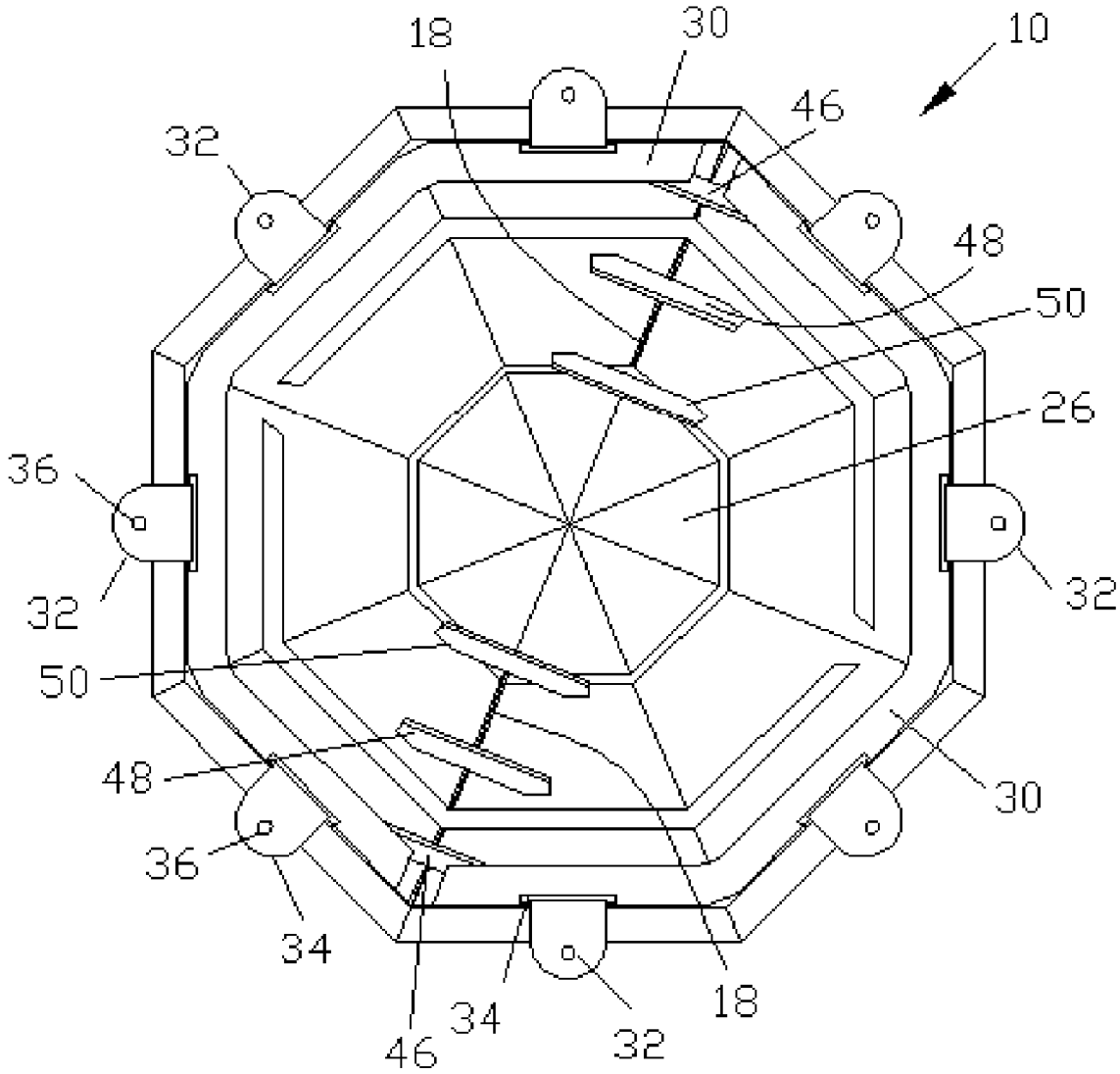
FIG. 3 is a bottom view of the chimney cap apparatus shown in FIG. 1 taken along section line 3—3 of FIG. 1.

The mounting assembly also includes a plurality of clips 32. FIG. 3 illustrates a bottom view of the device taken along section line 3—3 of FIG. 1. Each clip 32 is receivable in a receptacle 34 in the L-brackets. One side of the clip includes an opening 36 for receiving a fastener which will be connected to the chimney 12.

As best seen in FIG. 2, each clip 32 also includes an elongated slot 38 which receives a fastener 40, such as a bolt, which will pass through the slot 38 and through an opening in the sidewall 14 of the device. Accordingly, by adjusting the positioning of the fastener 40 in the slot 38, the clip 32 may be used to adjust the level of the device with respect to the chimney 12.

The device 10 also includes a pair of parallel, internal brace rings 42 and 44. The brace rings are parallel to the L-brackets of the inner frame 30. The continuous internal brace rings 42 and 44 may also be fabricated from L-shaped stainless steel or other metal which is compatible and non-reactive to the sidewalls and be attached by fasteners such as screws or rivets 52 to the sidewalls 14.

As best seen in FIGS. 2 and 3, the sidewall panels are joined together by internal corner braces 46, 48 and 50. The corner braces 46, 48 and 50 may be held to the sidewalls by tabs and slots.

Finally, semi-cylindrical molding 54 may be fastened to the sidewalls 14 both as a decorative feature and to hide the fasteners for the internal brace rings as best seen in FIG. 2. The edges of the molding terminates in extending tabs which are receivable in slots punched in to the sidewalls. Once inserted, the tabs are twisted to lock in place.

The entire device may be fabricated without welding, which eliminates undesirable weld marks and which is easy to manufacture.

In order to manufacture or fabricate the device 10, a tubular housing is manufactured. A pair of flat metal plates are fabricated by punching and folding so that each sheet forms four panels. The two sheets are then brought together and joined at the seams 8 so that a truncated octagon is formed. During the stamping process, the louver openings 20 and the exit openings 22 are stamped into the sidewalls.

Additionally, a top 26 is fabricated from flat sheet metal by stamping and folding or rolling. The top is connected to the sidewalls by fasteners such as rivets.

As a separate step, the inner frame and mounting assembly 30 is attached to the sidewalls 14 by rivets. Additionally, the pair of continuous internal inner brace rings 42 and 44 are attached to the sidewalls by rivets.

The tabs on the moldings 54 are inserted into slots in the sidewalls and the tabs on the moldings 54 are twisted in order to lock the moldings in place.

The assembled device 10 is lightweight and may be moved to a rooftop for attachment to the chimney 12 using the clips 32 which are received in receptacles in the inner frame and mounting assembly.

Figure 4:
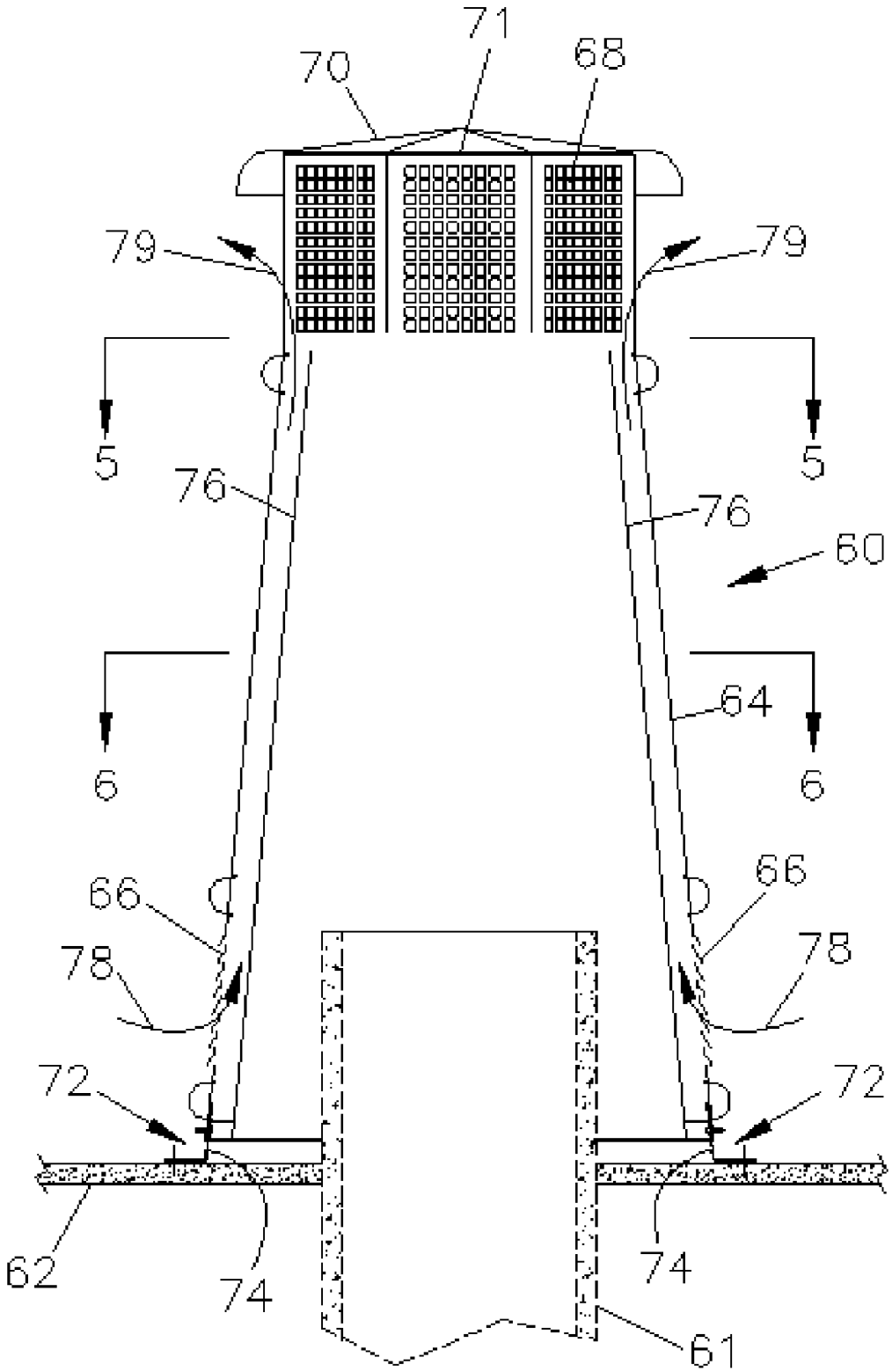
FIG. 4 is a cross-sectional view of a second, alternate embodiment of the chimney cap apparatus.

FIG. 4 shows a cross-sectional view of a second, alternate preferred embodiment of the cap device 60 constructed in accordance with the present invention. The device 60 would be installed over a flue opening 61 of a chimney 62, a portion of which is shown in FIG. 4. The flue opening 61 extends above the level of the chimney 62 and releases heat and smoke. The cap device 60 would sit at the top of the chimney 62 and surround a flue opening 61.

The cap device 60 includes a tubular housing 64 having a plurality of planar sidewalls which are fabricated from sheet metal. In the present embodiment, the sidewalls form an octagon and are truncated so as to narrow moving away from the chimney 62 toward the top. It will also be understood that the device 60 may have a tubular housing in the form of a conical cylinder (not shown). Further, it will be understood that the device may have a cross-section in the form of a hexagon, square or other configuration within the spirit and scope of the present invention.

Figure 5:
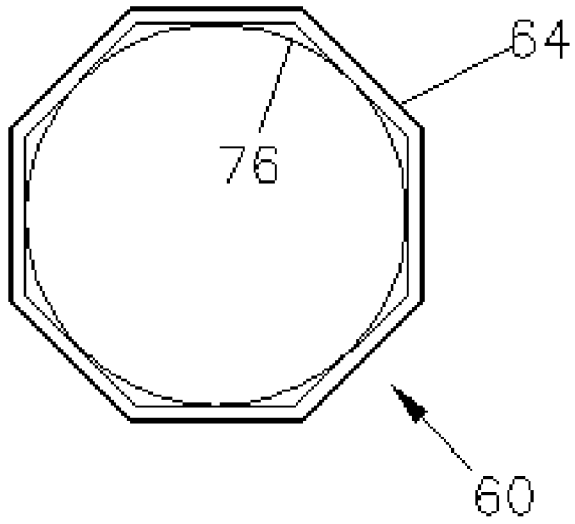
FIG. 5 is a sectional view taken along section line 5—5 of FIG. 4.
Figure 6:
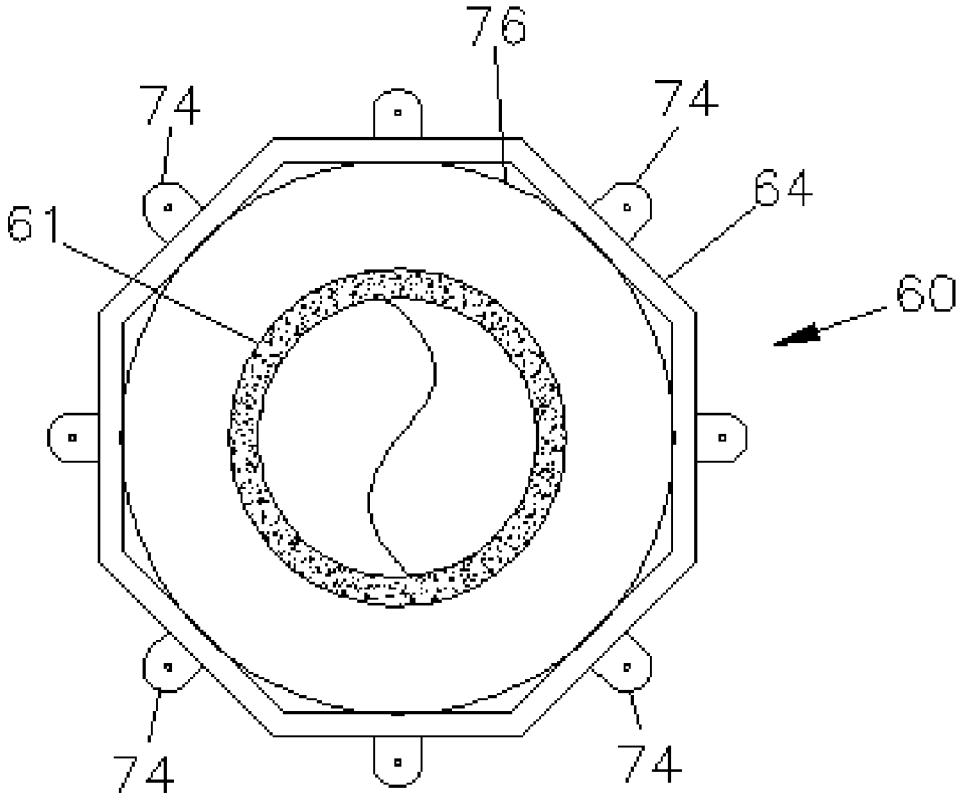
FIG. 6 is a sectional view taken along section line 6—6 of FIG. 4.

FIG. 5 is a sectional view o the device 60 taken along section line 5—5 of FIG. 4 while FIG. 6 is a sectional view taken along section line 6—6 of FIG. 4.

The tubular housing 64 includes a plurality of louver openings 66 which are stamped, formed, or otherwise made into a lower portion of the tubular housing. The louver openings 66 permit atmospheric air to pass through the tubular housing.

At the top of each sidewall panel, opposed to the louver openings 66 are a plurality of exit openings 68 which are stamped, punched, formed, or otherwise made into the sidewalls. Each exit opening 68 is relatively small and will not allow for birds, squirrels or other small animals to crawl therethrough. The exit openings are at least equal to a cross-sectional area of the flue opening 61. The tubular housing 64, thus, has an imperforated portion between the lower and the upper portion.

A top 70 is attached to the upper end of the tubular housing 64 by fasteners. The top may be fabricated from flat sheet metal with the outer edge of the top being split and then rolled or pressed to form a downward lip. A heat shield liner 71 is installed beneath the top 70 so that the top 70 is insulated from heat.

The cap device 60 also includes an inner frame and mounting assembly 72 as previously described in detail above with respect to the embodiment in FIGS. 1 through 3. The assembly 72 includes a series of L-brackets 74.

The cap device 60 also includes a liner 76 which extends from the lower area of the louver openings 66 past the imperforated section and up to the exit openings 68. As best seen in FIGS. 5 and 6, the liner 76 is cylindrical (circular in cross section) while the tubular housing 64 is in a polygon form so that spaces exist between the liner 76 and the tubular housing. Accordingly, as seen in FIG. 4, ambient air is drawn through the louvers 66 as illustrated by arrows 78, up through the spaces between the liner 76 and the tubular housing 64 and out of the exit openings as shown by arrows 79.

Warm air and smoke thus passes from the flue opening 61 through the liner 76 and out the exit openings 68.

In addition, ambient air enters the chambers or spaces between the tubular housing 64 and the liner 76. In use, the liner 76 will be heated from rising heat and smoke from the flue 61. Accordingly, the warm air will be encouraged and drawn upward through the spaces where it will mix with smoke rising from the flue 61 and thereafter be drawn out to the atmosphere through the exit openings 68 as shown by arrows 79. Accordingly, the ambient air moving in the spaces or chambers between the liner and the tubular housing not only acts to insulate the tubular housing 64 from heat but also acts to assist in drawing smoke from the flue upward and out of the exit openings 68.

Figure 7:
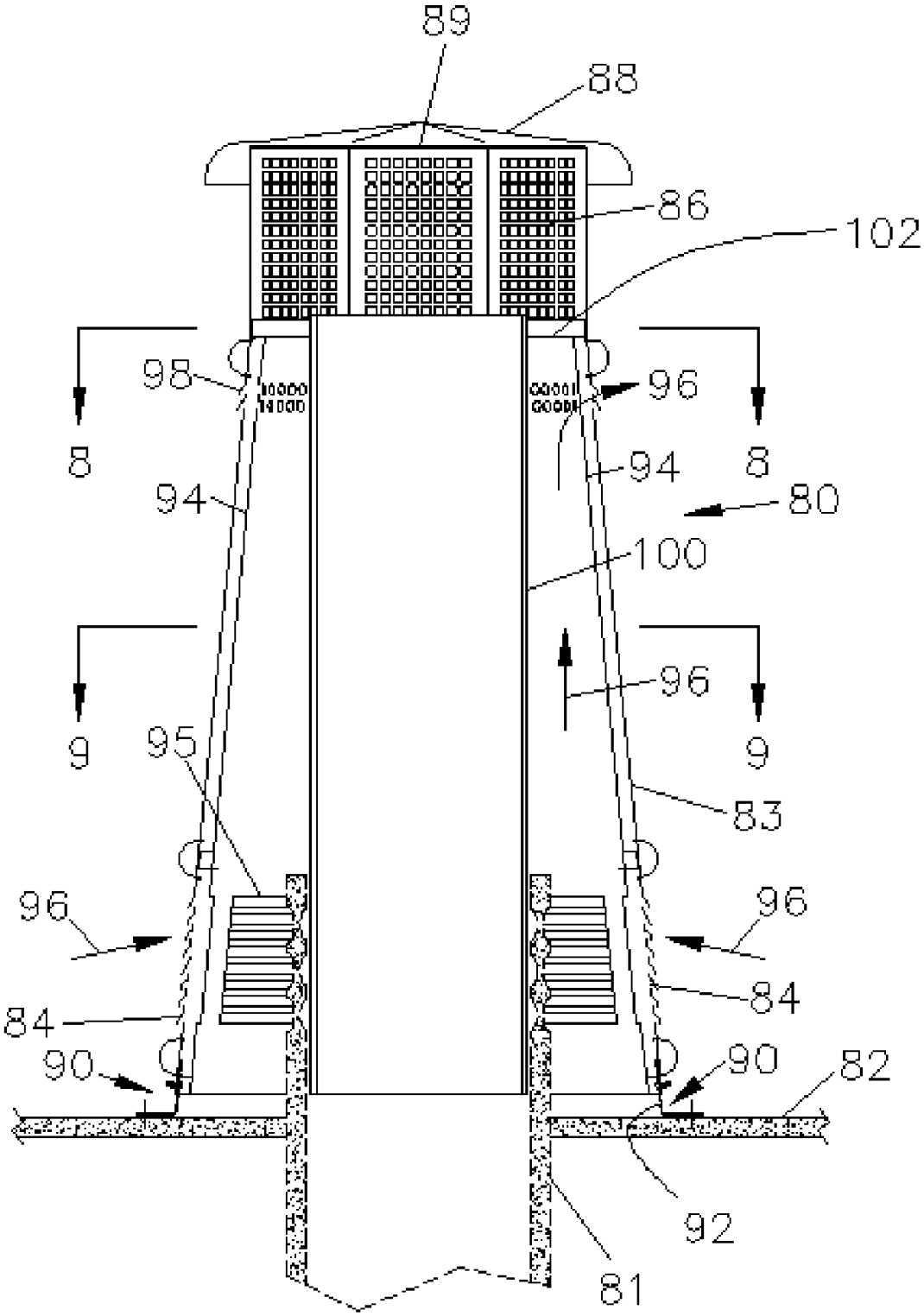
FIG. 7 is a cross-sectional view of a third, alternate embodiment of the chimney cap apparatus.

FIG. 7 shows a cross-sectional view of a third, alternate embodiment of the cap device 80 constructed in accordance with the present invention. The cap device 80 would be installed over a metal flue pipe opening 81 of a chimney 82, a portion of which is shown in FIG. 7. The flue opening 81 extends above the level of the chimney 82. The cap device would sit at the top of the chimney 82 and surround the flue opening 81.

The device 80 includes a tubular housing having 83 a plurality of planar sidewalls fabricated from sheet metal. In the embodiment shown, the sidewalls form an octagon and are truncated so as to narrow moving away from the chimney toward the top. It will be understood that the device 80 may have a tubular housing in the form of a conical cylinder (not shown). Further, it will be understood that the device 80 may have other configurations.

Figure 8:
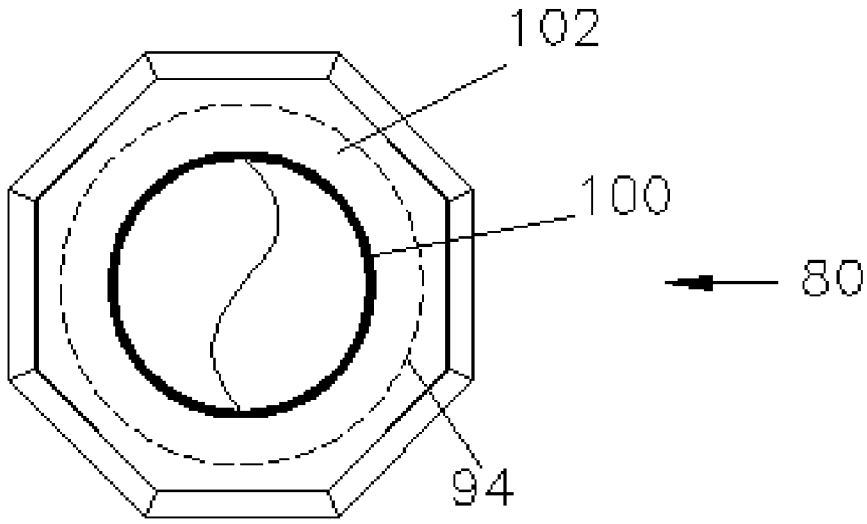
FIG. 8 is a sectional view taken along section line 8—8 of FIG. 7.
Figure 9:
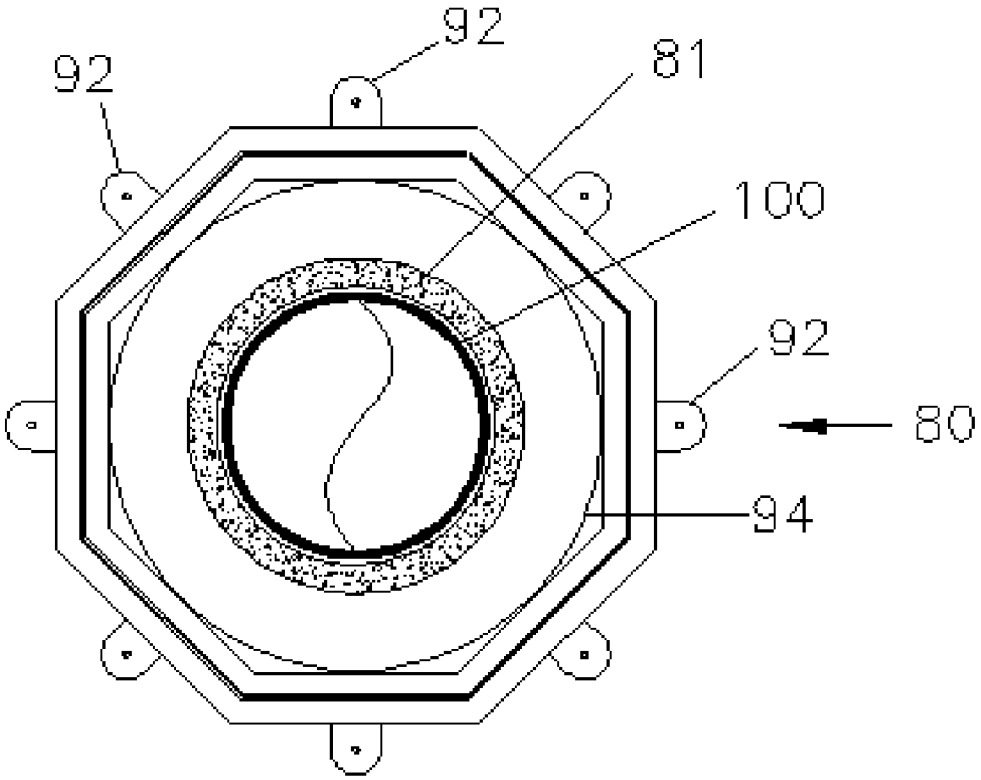
FIG. 9 is a sectional view taken along section line 9—9 of FIG. 7.

FIG. 8 is a sectional view taken along section line 8—8 of FIG. 7 while FIG. 9 is a sectional view taken along section line 9—9 of FIG. 7. The tubular housing 83 includes a plurality of louver openings 84 which are stamped, formed or otherwise made into a lower portion of the tubular housing.

At the top of the tubular housing 83, opposed and spaced from the louver openings 84 are a plurality of exit openings 86 which are stamped, punched, formed or otherwise made into the tubular housing. Each exit opening 86 is relatively small and will not allow for birds, squirrels or other small animals to crawl therethrough. The exit openings are at least equal to a cross-sectional area of the metal flue pipe opening 81. The tubular housing 83, thus, has an imperforated portion between the lower, louver openings and the upper, exit openings.

A top 88 is attached to the upper end of the tubular housing 83 by fasteners. The top may be fabricated from flat sheet metal with the outer edge of the top being split and then rolled or pressed to form a downward lip. A heat shield liner 89 is installed beneath the top 88 so that the top 88 is insulated heat.

The cap device 80 includes an inner frame and mounting assembly 90 as previously described in detail above with respect to the other embodiments. The inner frame and mounting assembly 90 includes a series of L-brackets 92.

The cap device 80 also includes a liner 94 which extends generally from the lower area of the louver openings 84 upward through the imperforated portion and up toward the exit openings 86. As best seen in FIG. 9, the liner 94 is conical (circular in cross-section) while the tubular housing 83 is in a polygon form.

The liner 94 contains an opening or openings 95 adjacent the louver openings 84 so that ambient air is drawn through the louver openings and through the liner 94 into the tubular housing as illustrated by arrows 96 outside the housing and arrows 96 within the housing. A set of upper louver openings 86 allow air to pass back out into the atmosphere as shown by arrows 96.

The cap device 80 also includes an inner sleeve 100 which it is to fit within the metal flue pipe opening 81. Accordingly, smoke is drawn upward through the flue opening where it exits through the exit openings 86 to the atmosphere. As seen in FIGS. 7 and 8, a plate 102 extends radially from the tubular housing to the sleeve 100 to form a barrier. The space between the sleeve 100 and the liner in tubular housing 94 forms a space to insulate the tubular housing 83 from the heat rising from the flue 81 and through the sleeve 100.

Whereas, the present invention has been described in relation to the drawings attached hereto, it should be understood that other and further modifications, apart from those shown or suggested herein, may be made within the spirit and scope of this invention.

What is claimed is:

1. A cap device for a flue opening of a chimney to enhance draw of smoke and to protect from entry of animals, debris, and the elements, which device comprises:

a tubular housing fabricated from flat sheet metal;

a top attached to said tubular housing;

a plurality of louver openings in a lower portion of said tubular housing to draw air;

a plurality of exit openings in an upper portion of said tubular housing above said louver openings, said tubular housing having an imperforated portion between said lower and said upper portions, wherein said exit openings are below said top;

an inner frame and mounting assembly attached to the lower edge of said tubular housing including anchoring and leveling means to anchor said inner frame and mounting assembly to said chimney and to level said device with respect to said chimney; and a liner within and attached to said tubular housing wherein said liner extends from said louver openings past said imperforated section and up to said exit openings to form at least one space between said liner and said tubular housing so that ambient air drawn through said louver openings will pass through said at least one space and out said exit openings in said upper portion of said tubular housing.

2. A cap device as set forth in claim 1 wherein said inner frame and mounting assembly is fabricated from L-bracket metal.

3. A cap device as set forth in claim 2 wherein said sidewalls and said top are copper and said inner frame and mounting assembly is stainless steel.

4. A cap device as set forth in claim 1 wherein said inner frame and mounting assembly includes receptacles, said anchoring and leveling means includes a plurality of clips attachable to said chimney wherein said clips are receivable in said receptacles in said inner frame and mounting assembly of said device.

5. A cap device as set forth in claim 4 wherein each said clip includes an elongated slot to adjust said level of said device.

6. A cap device as set forth in claim 1 including a plurality of continuous brace rings spaced along the internal surface of said housing.

7. A cap device as set forth in claim 6 including a pair of said brace rings parallel to each other.

8. A cap device as set forth in claim 1 wherein said tubular housing includes discreet panels joined by internal corner braces.

9. A cap device as set forth in claim 1 wherein said tubular housing has a cross-section in a form chosen from the group consisting of an octagon, a hexagon, a square, a rectangle or a circle.

10. A cap device as set forth in claim 1 wherein said top is fabricated from said flat sheet metal.

11. A cap device as set forth in claim 1 wherein said louver openings and said exit openings are stamped into said flat sheet metal.

12. A cap device as set forth in claim 1 wherein each said louver opening faces upward to enhance draw.

13. A process to fabricate a cap for a chimney flue opening, which process comprises:

stamping sidewalls from flat sheet metal wherein said sidewalls include a plurality of louver openings in a lower portion to draw air, a plurality of exit openings in an upper portion spaced from and above said louver openings and an imperforate section therebetween;

attaching an inner frame and mounting assembly within said sidewalls;

attaching a plurality of continuous inner brace rings to said sidewalls;

forming a top lid from flat sheet metal and attaching said top lid to said sidewalls above said exit openings;

attaching an inner liner within said sidewalls wherein said liner extends from said louver openings past said imperforated section and up to said exit openings to form a space or spaces between said liner and the sidewalls so that ambient air drawn through said louver openings will pass through said space or spaces and out said exit openings; and inserting a plurality of clips in receptacles in said inner frame and mounting assembly and fastening said clips through a slot in each said clip to both anchor and level said device.

14. A process to fabricate a cap device as set forth in claim 13 wherein said louver openings and said exit openings are stamped into said flat sheet metal.

15. A process to fabricate a cap device as set forth in claim 13 including the additional step of inserting a plurality of clips in receptacles in said cap and fastening said clips through a slot in each clip in order to adjust the level of said device.

16. A process to fabricate a cap device as set forth in claim 13 including attaching a plurality of internal brace rings within said sidewalls by fasteners.

17. A cap device as set forth in claim 1 wherein said liner is circular in cross section.

* * * * *